US005832886A

United States Patent [19]

Grob et al.

[11] Patent Number: 5,832,886

[45] Date of Patent: Nov. 10, 1998

[54] APPARATUS FOR ADJUSTING A CAMSHAFT OF AN INTERNAL COMBUSTION ENGINE

[75] Inventors: Ferdinand Grob, Besigheim; Udo Sieber, Hessigheim, both of Germany

[73] Assignee: Robert Bosch GmbH, Stuttgart, Germany

[21] Appl. No.: 764,415

[22] Filed: Dec. 11, 1996

[30] Foreign Application Priority Data

Dec. 16, 1995 [DE] Germany ..... 195 47 101.6

[51] Int. Cl.[6] ..... F01L 1/34

[52] U.S. Cl. ..... 123/90.17; 123/90.31; 123/90.24

[58] Field of Search ..... 123/90.15, 90.17, 123/90.31, 90.24, 90.6

[56] References Cited

U.S. PATENT DOCUMENTS

| | | | |
|---|---|---|---|
| 4,305,352 | 12/1981 | Oshima et al. | 123/90.15 |
| 4,476,823 | 10/1984 | Williams et al. | 123/90.15 |
| 4,747,375 | 5/1988 | Williams | 123/90.15 |
| 4,986,801 | 1/1991 | Ohlendorf et al. | 123/90.17 |
| 5,327,859 | 7/1994 | Pierik et al. | 123/90.17 |
| 5,329,894 | 7/1994 | Phoenix et al. | 123/90.17 |
| 5,361,736 | 11/1994 | Phoenix et al. | 123/90.17 |
| 5,586,527 | 12/1996 | Arutunoff et al. | 123/90.15 |

FOREIGN PATENT DOCUMENTS

WO9416203 7/1994 WIPO .

*Primary Examiner*—Weilun Lo
*Attorney, Agent, or Firm*—Edwin E. Greigg; Ronald E. Greigg

[57] ABSTRACT

An apparatus for adjusting a camshaft of an internal combustion engine, having first and second shafts, of which the first shaft is driven to rotate at least indirectly by the engine and of which at least the second shaft is embodied as a camshaft for actuating a gas exchange valve of the engine, and the transmission of the rotary motion of the driven first shaft to the driven second shaft is effected by means of a coupling gear, by way of which moreover the relative rotary position of the shafts to one another can be varied. For the freest possible adjustment of the phase location of the shafts to one another, the coupling gear is embodied between the shafts as a planetary gear.

8 Claims, 2 Drawing Sheets

APPARATUS FOR ADJUSTING A CAMSHAFT OF AN INTERNAL COMBUSTION ENGINE

BACKGROUND OF THE INVENTION

The invention is based on an apparatus for adjusting a camshaft of an internal combustion engine. In one such apparatus, known from International Application WO 94/16203, for variable valve stroke adjustment of a gas exchange valve in an internal combustion engine, a coupling gear is provided between an opening camshaft and a closing camshaft of the valve; by way of it, the relative rotary positions of the camshafts can be adjusted relative to one another. This coupling gear comprises four pinions having the same number of teeth, which mesh in pairs with one another. One pinion is rigidly connected to the opening camshaft and the other with the closing camshaft. These two camshaft pinions do not mesh with one another but instead communicate with one another via two further pinions (detour pinions). To that end, the pinions are provided as a closed, four-member pivot joint gear, arranged in a parallelogram, whose upper pivot points are provided on the opening and closing camshafts. The two detour pinions are movably supported in the two lower pivot points. A lateral joint element leading through the pivot points, one above the other, of a camshaft pinion and of the detour pinion meshing with that pinion is embodied as a lever, lengthened toward the bottom; the rotary motion of this lever causes a relative change in rotary position (phase change) between the opening and closing camshafts.

However, the known adjusting apparatus has the disadvantage that adjusting the phase change of the camshafts to another phase is limited because the rotary joint gear is not capable of revolving. Furthermore, the motion of the lever is limited by two mechanical stops. Another disadvantage of the known adjusting apparatus is that the desired phase location must be set even before or during mounting on the engine, which involves increased production cost and assembly expense.

OBJECT AND SUMMARY OF THE INVENTION

The apparatus according to the invention for adjusting a camshaft of an internal combustion engine has an advantage over the prior art that completely free adjustment of the phase location of the camshafts to one another can be done over a range of 360° of rotation. In the adjusting apparatus of the invention, both camshafts can be mounted in an arbitrary phase location together with the other components of the coupling gear and the drive, which considerably lowers the expense for production and assembly. Calibration of the phase location of the camshafts is then done in the mounted state, via the coupling gear.

The coupling gear is to that end embodied as a planetary gear, whose carrier shaft and gear shafts are connected to the camshafts and an arbitrarily adjustable adjusting shaft. The adjusting shaft that trips the adjustment of the phase location is advantageously actuated by an electric control motor. For optimal adaptation of the rotary motion of the carrier shaft and gear shafts of the planetary gear to the requirements of the camshaft motion or of the adjusting shaft, stationary transmissions can alternatively be provided at the coupling point between the planetary gear and the camshafts or drive motor; these transmissions are advantageously embodied as two-wheel step-up gears, for instance, which are disposed in stationary fashion relative to the engine housing. The preferred at least three-wheel planetary gear may alternatively be embodied as a positive or negative gear and can thus be adapted flexibly to given requirements.

The provision of two gear shafts with one carrier shaft on the planetary gear, two camshafts of the engine, and one adjusting shaft makes for six possible coupling options, which can be represented as follows:

Option 1:
1st camshaft+1st gear shaft
2nd camshaft+2nd gear shaft
adjusting shaft+carrier shaft Option 2:
1st camshaft+1st gear shaft
2nd camshaft+carrier shaft
adjusting shaft+2nd gear shaft Option 3:
1st camshaft+2nd gear shaft
2nd camshaft+1st gear shaft
adjusting shaft+carrier shaft Option 4:
1st camshaft+2nd gear shaft
2nd camshaft+carrier shaft
adjusting shaft+1st gear shaft Option 5:
1st camshaft+carrier shaft
2nd camshaft+1st gear shaft
adjusting shaft+2nd gear shaft Option 6:
1st camshaft+carrier shaft
2nd camshaft+2nd gear shaft
adjusting shaft+1st gear shaft The adjusting apparatus according to the invention may, as in the exemplary embodiments described be provided between two camshafts, but it is alternatively possible to rotate one camshaft relative to a crankshaft or two shafts in general counter to one another with the adjusting apparatus of the invention.

Further advantages and advantageous features of the subject of the invention may be learned from the specification, drawing and claims.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
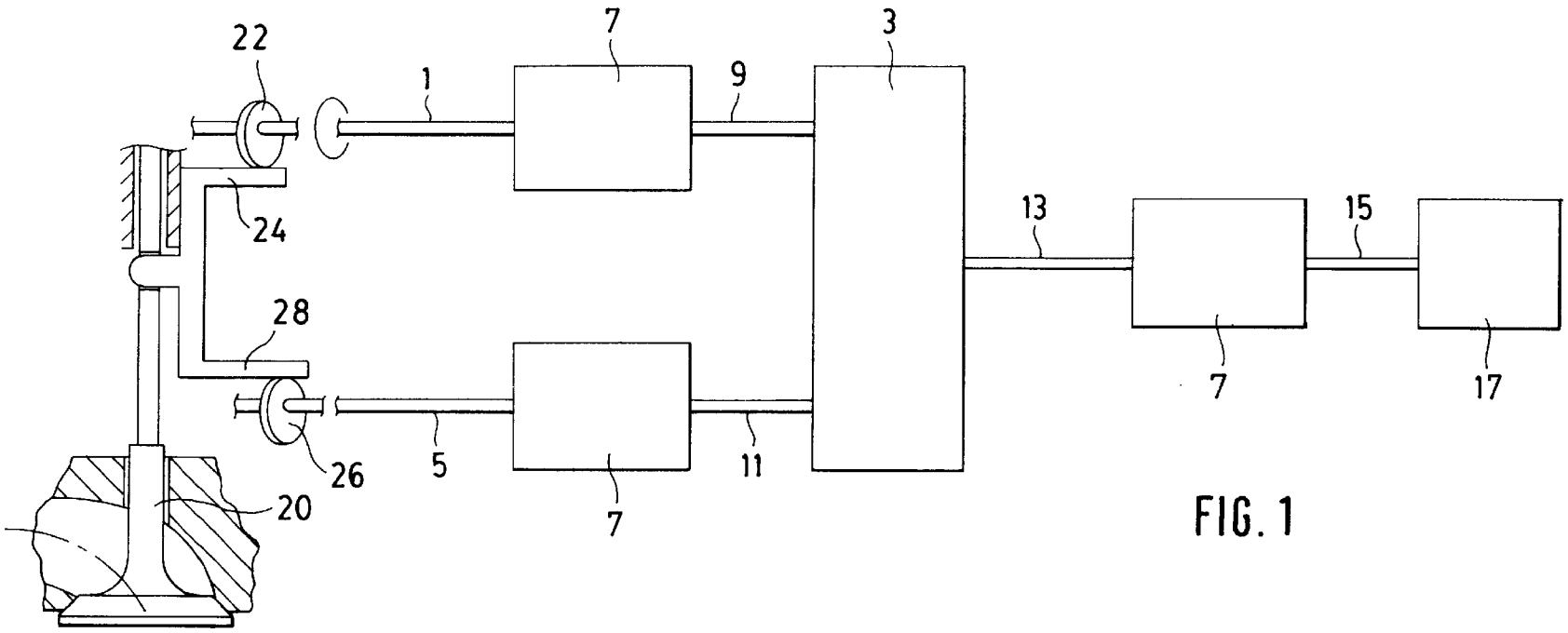
FIG. 1 illustrates the principle of the adjusting apparatus.

In the illustration in FIG. 1 of the principle of the apparatus according to the invention for adjusting a camshaft of an internal combustion engine, a first camshaft 1 is driven to rotate, in a manner not shown in further detail, by an engine. The first camshaft 1 is connected to a second camshaft 5 via a coupling gear, embodied as a planetary gear 3, and thus drives a second camshaft 5 at a rotary speed synchronized with the engine. The first camshaft 1 preferably controls the opening stroke motion of a gas exchange valve 20 of the engine by use of a cam 22 that operates a cam arm 24 which is connected to the valve 20 while the second camshaft 5 controls the closing stroke motion of the valve 20 via a cam 26 and arm 28. For adapting the rotary motion of the camshafts 1 and 5, stationary transmissions 7 are also alternatively provided on the camshafts 1 and 5; by way of these transmissions, the first camshaft 1, in the exemplary embodiment shown, is connected to a first gear shaft 9, and the second camshaft 5 is connected to a second gear shaft 11 of the planetary gear 3. It is alternatively possible also to couple the camshafts 1, 5 to the gear shafts 9, 11 directly. To change the relative rotational position of the camshafts 1 and 5 to one another, a carrier shaft 13 of the planetary gear 3 is connected to an adjusting shaft 15, which in turn is actuated to an arbitrarily triggerable electric drive motor 17. The carrier shaft 13 is also coupled to the adjusting shaft 15 via a stationary transmission 7, by means of which the rotary motion of the adjusting shaft 15 can be adapted to the requirements of the planetary gear 3.

Figure 2:
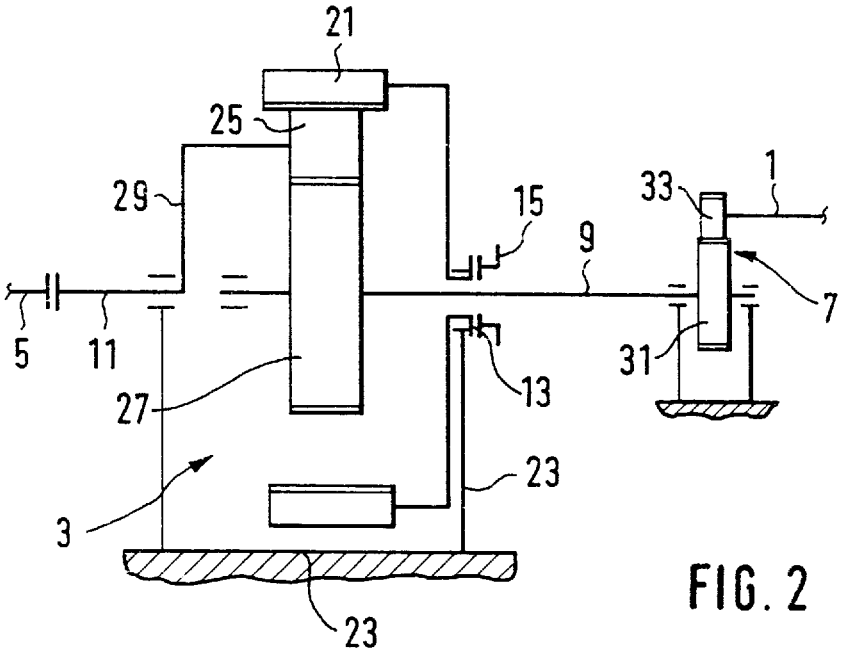
FIGS. 2 and 3 show two exemplary embodiments of the coupling gear, embodied as a planetary gear, between the camshafts; the first exemplary embodiment shown in FIG. 2 shows a negative planetary gear, and the second exemplary embodiment shown in FIG. 3 shows a positive planetary gear.

FIG. 2 shows a first exemplary embodiment of the planetary gear 3, to whose gear shafts 9, 11 and carrier shaft 13 the camshafts 1, 5 and the adjusting shaft 15 of FIG. 1 are coupled. The illustration of the stationary transmissions 7 is limited to a single step- up gear, provided between the first camshaft 1 and the first gear shaft 9, since the other stationary transmissions 7 are embodied analogously.

The planetary gear 3 in the first exemplary embodiment is embodied as a three-wheel negative gear, in which the drive wheel and the driven wheel revolve contrary to one another. The planetary gear 3 has a carrier wheel 21, whose carrier shaft 13 is rotatably supported on a housing 23. The carrier wheel 21, on its inside diameter, has a set of internal teeth, which meshes with a set of outer teeth on a revolving wheel 25 (planet wheel) revolving inside the carrier wheel 21. The shaft of the planet wheel 25 is supported, via a web 29, coaxially with the carrier shaft 13 on the housing 23 and in this exemplary embodiment forms the gear shaft 11. In the center of the interior of the carrier wheel 21, a sun wheel 27 is also supported on the housing; with its set of outer teeth it likewise meshes with the planet wheel 25, and its shaft coaxial with the carrier shaft forms the first gear shaft 9. This gear shaft 9, on its end remote from the planetary gear 3, is connected to a first gear wheel 31 of the stationary transmission 7, which is guided in the housing 23. Meshing with this first gear wheel 31 is a second gear wheel 33, which has a diameter different from that of the first gear wheel 31 and which in turn is connected to the first camshaft 1. The stationary transmission 7 may also have more gear wheels, as needed, and may be embodied as a spur gear or the like.

The adjusting apparatus shown in FIGS. 1 and 2 functions as follows:

When the engine is in operation, the first camshaft 1 is driven to rotate, and it transmits this rotary motion via the stationary transmission 7 to the first gear shaft 9 of the planetary gear 3. The first gear shaft 9 drives the sun wheel 27, connected firmly to it, so that it rotates, and thus with the carrier wheel 21 stationary, the planet wheel 25 revolves around the sun wheel 27. This revolving motion of the planet wheel 25 is converted via the web 29 into a rotary motion of the second gear shaft 11, which consequently drives the second camshaft 5 to rotate.

If an adjustment of the phase or rotary position of the first and second camshaft 1, 5 to one another is to be done, then the adjusting shaft 15 and also the carrier shaft 13 are rotated by the electric drive motor 17. The rotation of the carrier shaft 13 causes rotation of the carrier wheel 21, as a consequence of which the phase location of the sun wheel 27 to the planet wheel 25 and also of the first camshaft 1 to the second camshaft 5 is adjusted.

The magnitude and direction of the adjustment can be determined freely via the rotary direction of the adjusting shaft, which depends on the current supplied to the adjusting motor 17.

It should also be noted that the gear shafts 9, 11 and the carrier shaft 13 of the planetary gear 3 can also be coupled to the camshafts 1, 5 and the adjusting shaft 15 via the other five options described above.

Figure 3:
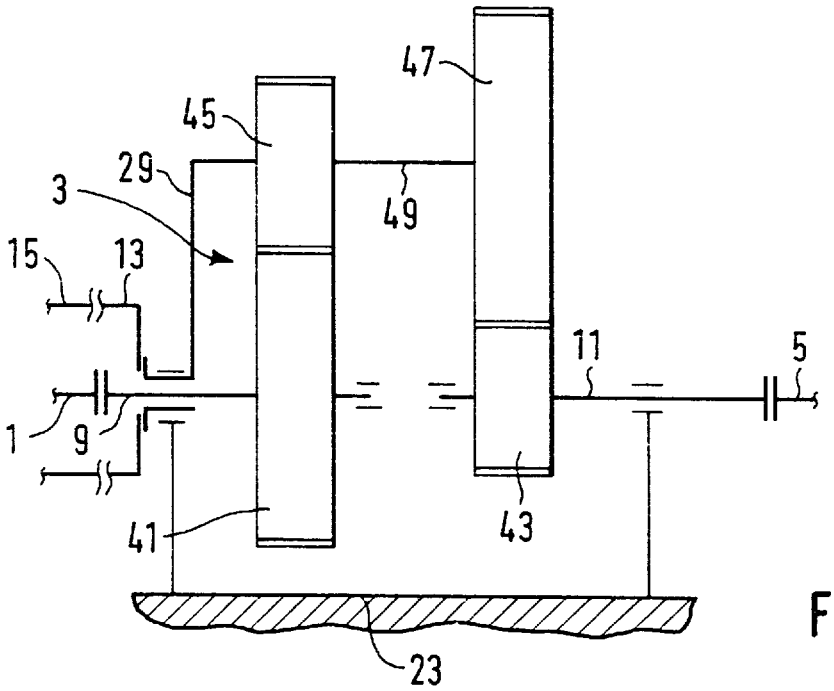

In the second exemplary embodiment shown in FIG. 3, the planetary gear 3 is embodied as a four-wheel positive gear, in which the drive shaft and driven shaft have the same direction of rotation.

To that end, the planetary gear 3 now comprises two pairs of gear wheels, in each of which a first gear wheel forms a sun wheel supported on the housing 23, the first sun wheel 41 being disposed on the first gear shaft 9 in a manner fixed against relative rotation. The second sun wheel 43 is supported independently of the first sun wheel 41 on the housing 23 via the second gear shaft 11; the gear shafts 9, 11 are coaxial with one another.

The operative connection between the first and second sun wheels 41, 43 is effected via the respective planet wheels meshing with them; the first planet wheel 45 meshing with the first sun wheel 41, and the second planet wheel 47 meshing with the second sun wheel 43, are connected to one another in a manner fixed against relative rotation via a common connecting shaft 49. This connecting shaft 49 is connected via a web 29, in a manner fixed against relative rotation, to the carrier shaft 13, which is supported on the housing and is in turn coaxial with the gear shaft 9.

The transmission of the rotary motion of the first camshaft 1 to the second camshaft 5 is now effective via the first sun wheel 41, the first planet wheel 45, the second planet wheel 47, and the second sun wheel 43. If an adjustment of the phase location of the camshafts 1, 5 to one another is to be done, then via the adjusting shaft 15, the carrier shaft 13 and the web 29, the location of the planet wheels 45, 47, coupled to one another via the connecting shaft 49, relative to the sun wheels 41, 43 is varied.

Thus by the use of a known planetary gear as a coupling gear between two shafts, and in particular two camshafts, it is possible in a simple way to adjust their phase location to one another over the entire rotary range of 360°.

In addition to the exemplary embodiments described for the planetary gears, reference may also be made to the applicable professional literature, from which many further embodiments of planetary gears and their function are known, and which can also be used as coupling gears between two camshafts.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for adjusting a camshaft of an internal combustion engine, comprising a driven first control shaft (1) which is driven to rotate at least indirectly by the engine to control an opening stroke motion of a gas exchange valve

20 of the engine, and a driven second control shaft (5) which is embodied as a camshaft and connected to the driven first control shaft via a planetary gear for controlling a closing stroke motion of the gas exchange valve (20) of the engine, and a transmission of a rotary motion of the driven first control shaft to the driven second control shaft is effected by said planetary gear which controls a relative rotary position of the driven first control shaft to the driven second control shaft said relative rotary position can be varied, the planetary gear is embodied between the driven first and second control shafts (1, 5), output gear shafts (9, 11) are connected with said planetary gear and to the driven first and second control shafts (1, 5), respectively, of the engine and an input carrier shaft (13) is connected to said planetary gear and to an arbitrarily actuatable adjusting shaft (15).

2. An apparatus in accordance with claim 1, in which the planetary gear (3) is embodied as a positive gear.

3. An apparatus in accordance with claim 1, in which the adjusting shaft (15) adjusts a relative rotary location of the driven first and second control shafts (1, 5) to one another via said planetary gear and is actuated by an electric control motor (17).

4. An apparatus in accordance with claim 1, in which fixed stationary transmissions (7) are provided at coupling points of the carrier shaft (13) and the output gear shafts (9, 11) of the planetary gear (3) and are related to the driven first and second control shafts (1, 5) and the adjusting shaft (15), said transmissions adapt the rotary motions of said driven first and second control shafts to given requirements.

5. An apparatus in accordance with claim 4, in which the stationary transmissions (7) are embodied as two-wheel step-up gears.

6. An apparatus in accordance with claim 1, in which the planetary gear (3) is embodied as a negative gear.

7. An apparatus in accordance with claim 6, in which the planetary gear (3) is embodied as a three-wheeled planetary gear.

8. An apparatus in accordance with claim 2, in which the planetary gear (3) is embodied as a four-wheeled planetary gear.

* * * * *